US009820522B2

(12) United States Patent
Prabhu et al.

(10) Patent No.: US 9,820,522 B2
(45) **Date of Patent: *Nov. 21, 2017**

(54) SHOCK WAVE MITIGATING HELMETS

(71) Applicant: Mississippi State University, Mississippi State, MS (US)

(72) Inventors: Rajkumar Prabhu, Starkville, MS (US); Mark F. Horstemeyer, Starkville, MS (US); Gustavus Alston Rush, Meridian, MS (US)

(73) Assignee: Mississippi State University, Mississippi State, MS (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/694,715

(22) Filed: Apr. 23, 2015

(65) Prior Publication Data

US 2015/0305427 A1 Oct. 29, 2015

Related U.S. Application Data

(60) Provisional application No. 61/983,133, filed on Apr. 23, 2014.

(51) Int. Cl.
*A42B 3/06* (2006.01)
*A42B 3/12* (2006.01)

(52) U.S. Cl.
CPC ..... *A42B 3/063* (2013.01); *A42B 3/061* (2013.01); *A42B 3/128* (2013.01)

(58) Field of Classification Search
CPC ..... A42B 3/063; A42B 3/128; A42B 3/064
USPC ..... 2/412; 267/166
See application file for complete search history.

(56) References Cited

U.S. PATENT DOCUMENTS 4,111,407 A 9/1978 Stager
4,292,702 A 10/1981 Phillips
5,687,426 A * 11/1997 Sperber ..... A42B 3/061 2/411
6,276,255 B1 8/2001 Field et al.
6,378,140 B1 4/2002 Abraham et al.
9,179,727 B2 * 11/2015 Grant ..... A42B 3/125

(Continued)

OTHER PUBLICATIONS

Bartoli, Ivan, et al., "Modeling Wave Propagation in Damped Waveguides of Arbitrary Cross-Section", Journal of Sound and Vibration, 295 (2006) pp. 685-707.

(Continued)

*Primary Examiner* — Clinton T Ostrup
*Assistant Examiner* — Heather Mangine
(74) *Attorney, Agent, or Firm* — Lawrence Arthur Schemmel

(57) ABSTRACT

A helmet, has a shell that includes a first portion and a second portion. The first portion has first, second and third layers. The second layer is positioned between the first layer and the third layer. The second layer is less dense than the first layer and the third layer. The second portion has a plurality of enemy dissipaters. Each of the energy dissipaters has a rod that extends in a spiraling manner from a fixed end to a free end. The rod tapers continuously along its length from the fixed end to the free end so that the fixed end exhibits a larger internal cross sectional area than the free end. The free end is capable of vibrating when the helmet is impacted by an object in order to dissipate impact energy.

19 Claims, 4 Drawing Sheets

(56) References Cited

U.S. PATENT DOCUMENTS

| | | | | |
|---|---|---|---|---|
| 2003/0217483 | A1* | 11/2003 | Abraham | A43B 13/182 36/28 |
| 2006/0059605 | A1* | 3/2006 | Ferrara | A42B 3/121 2/410 |
| 2011/0227353 | A1 | 9/2011 | Nagwanshi et al. | |
| 2013/0185837 | A1* | 7/2013 | Phipps | A42B 3/12 2/2.5 |

OTHER PUBLICATIONS

Treyssede, Fabien, "Elastic Waves in Helical Waveguides", Wave Motion 45 (2008), pp, 457-470.
Snively, Eric, et al.; "Common Functional Correlates of Head-Strike Vehavior in the Pachycephalosaur Stegorceras validum (Ornithiochia, Dinosauria) and Combative Artiodactyls", PLos One, vol. 6, Issue 6, Jun. 2011, pp. 1-26.
Setchell, Robert E. et al.. "An Investigation of Shock Strengthening in a Conical Convergent Channel", J. Fluid Mech. (1972), vol. 56, part 3, pp. 505-522.
Munch, E., et al, Tough, Bio-Inspired Hybrid materials, Science, vol. 322, Dec. 5, 2008, pp. 1516-1520.
Yoon; Sang-Hee, et al., "A Mechanical Analysis of Woodpecker Drumming and It's Application to Chock-Absorbing Systems", Bioinspiration & Biomimetrics, vol. 6, (2011), pp. 1-12.
Ressl, Marc. S., et al. "Design of an Acoustic Anechoic Chamber for Application in Hearing Aid Research", Recent Advances in Acoustics & Music, Proceedings of the 11th WSEAS International Conference on Acoustics & Music: Theory & Applications (AMTA '10), Jun. 2010.
Willinger, Remy, et al. "Three-Dimensional Human Head Finite-Element Model Validation Against Two Experimental Impacts", Annals of Biomedical Engineering, vol. 27, pp. 403-410, 1999.
Oda, Juhachi, et al., "Mechanical Evaluation of the Skeletal Structure and Tissue of the Woodpecker and It's Shock Absorbing System", JSME International Journal, Series A, vol. 49, No. 3, 2006, pp. 390-396.
Mohammed, Javeed Shaikh, et al., "Bioinspired Design of Dynamic Materials", Adv. Mater, 2009, 21, pp. 2361-2374.
Maity, Parimal, et al., "Finite Element of Ramming in Ovis Canadensis", Journal of Biomechanical Engineering, vol. 133, Feb. 2011, pp. 021009-1 to 021009-9.
Mace, Brian R., et al., "Finite Element Prediction of Wave Motion in Structural Waveguides", J. Acoust. Soc, Am., vol. 117, No. 5, May 2005, pp. 2836-2842.
Hayashi, Takahiro, et al., "Guided Wave Dispersion Curves for a Bar with an Arbitrary Cross-Section, a Rod and Rail Example", Ultrasonics, vol. 41, 2003, pp. 175-183.
Bond, C., "Shock Focusing in a Planar Convergent Geometry: Experiment and Simulation", J. Fluid Mech (2009), vol. 641, pp. 297-333.
Gavric, L., "Computation of propagative Waves in Free Rail Using a Finite Element Technique", Journal of Sound and Vibration, (1995), vol. 185(3), pp. 531-543.
Demma, A., "The Effect of Bends on the Propagation of Guided Waves in Pipes", Transactions of the ASME, vol. 127, Aug. 2005, pp. 328-335.
Shergold, Oliver A., et al., "The Uniaxial Stress Versus Strain Response of Pig Skin and Silicone Rubber at Low and High Strain Rates", International Journal of Impact Engineering, vol. 32, pp. 1384-1402, 2006.
Farke, Andrew A., "Frontal Sinuses and Head-Butting in Goats: A finite Element Analysis", The Journal of Experimental Biology, vol. 211, pp. 3085-3094, 2008.
Trim, Michael W., "The Effects of Water and Microstructure on the Mechanical Properties of Bighorn Sheep (Ovis Canadensis) Horn Keratin", Acta Biomaterialia. vol. 7, pp. 1228-1240, 2011.
Chafi, M.S., et al., "Biomechanical Assessment of Brain Dynamic Responses Due to Blast Pressure Waves", Annals of biomedical Engineering, vol. 38, No. 2, Feb. 2010, pp. 490-504.
Tombolato, Luca, et al., "Microstructure, Elastic Properties and Deformation mechanisms of Horn Keratin", Acta Biomaterialia, vol. 6, pp. 319-330, 2010.
Frikha, Ahmed, et al., "Effect of Axial Load on the Propagation of Elastic Waves in Helical Beams", Wave Motion, vol. 48, pp. 83-92, 2011.
Bright, Jen A., "Sensitivity and Ex Vivo Validation of Finite Element Models of the Domestic Pig Cranium", Journal of Anatomy, vol. 219, pp. 456-471, 2010.
Hogg, D.A., "The Development of Pneumatisation in the Postcranial Skeleton of the Domestic Fowl", Journal of Anatomy, vol. 139, pp. 105-113, 1984.
Bioon, Auditory and Vestibular Pathways, http://www.bioon.com/bioline/neurosci/course/audvest.html, accessed Jul. 7, 2015.
National Wildlife Foundation, Bighorn Sheep, accessed Sep. 10, 2014, http://www.nwf.org/wildlife/wildelife~libary/mammals/bighorn-sheep.aspx.
Merck, Ears, Accessed Sep. 10, 2014, http://merckmanuals.com/home/ear_nose_and_throat_disorders/biology-of_the_ears_nose_and_throat/ears.html.
Roymech, Helical Sprin Design, archived Feb. 22, 2007, http://roymech.co.uk/Useful_Tables/Springs_helical.html#Rectangular.
"Vibration," Dictionary.com, accessed Feb. 24, 2016, http://dictionary.reference.com/browse/vibration.
"NASA," "Numerical Simulation of Flow Past a Tapered Cylinder," AIAA Paper 91-0751, 1991.

* cited by examiner

SHOCK WAVE MITIGATING HELMETS

CROSS-REFERENCE TO RELATED APPLICATIONS

The present application is a non-provisional application of, and claims priority to, U.S. Provisional Application No. 61/983,133, filed on Apr. 23, 2014 and titled "Shock-Wave Mitigating Bio-Inspired Football Helmet Design," which is incorporated by reference herein in its entirety.

BACKGROUND

Mild Traumatic Brain Injury (MTBI), commonly referred to as "a concussion," is an injury that frequently occurs in contact sports, such as football. Sport-related brain injuries have been estimated to occur 1.6 to 3.8 million times every year. Additionally, it is estimated that some football players receive up to 1,500 head impacts per season. Although every impact may not result in MTBI, numerous impacts to the head can result in long-term brain damage through an impact induced neurodegenerative disease known as Chronic Traumatic Encephalopathy (CTE).

SUMMARY OF THE INVENTION

The present disclosure provides various embodiments of shock wave mitigating helmets.

One embodiment, among others, is a helmet that comprises a shell having a first portion and a second portion. The first portion comprises a first layer, a second layer, and a third layer, wherein the second layer is positioned between the first layer and the third layer and wherein the second layer is less dense than the first layer and the third layer. The second portion of the shell comprises a plurality of energy dissipaters mounted within the second portion of the shell. Each of the energy dissipaters has a rod that extends in a spiraling manner from a fixed end to a free end. The rod tapers continuously along its length from the fixed end to the free end so that the fixed end exhibits a larger internal cross sectional area than the free end. The free end is capable of vibrating when the helmet is impacted by an object in order to dissipate impact energy.

Another embodiment, among others, is a helmet that comprises a shell having a first layer, a second layer, and a plurality of energy dissipaters positioned between the first layer and the second layer. Each of the energy dissipaters has a rod that extends in a spiraling manner from a fixed end to a free end. The rod tapers continuously along its length from the fixed end to the free end so that the fixed end exhibits a larger internal cross sectional area than the free end. The free end is capable of vibrating when the helmet is impacted by an object in order to dissipate impact energy.

BRIEF DESCRIPTION OF THE DRAWINGS

Many aspects of the present disclosure can be better understood with reference to the following drawings. The components in the drawings are not necessarily to scale, with emphasis instead being placed upon clearly illustrating the principles of the disclosure. Moreover, in the drawings, like reference numerals designate corresponding parts throughout the several views.

DETAILED DESCRIPTION

The present disclosure relates to helmets that protect a wearer's head and reduce the likelihood of the wearer experiencing Mild Traumatic Brain Injury (MTBI), Chronic Traumatic Encephalopathy (CTE), or other types of injuries. The helmet in some embodiments comprises a shell that has a first portion and a second portion. The first portion of the shell may include a core layer that is surrounded by layers that are denser than the core layer. For example, the core layer may be constructed of a foam, and the surrounding layers may be constructed of a para-aramid synthetic fiber, such as a KEVLAR fiber, fixed in a matrix. Because the core layer is less dense than the surrounding layers, the first portion of the shell may mitigate shock waves that are imparted to the helmet.

Furthermore, in some embodiments, a suture may be formed in one of the layers that surrounds the core layer. An elastomeric adhesive may be disposed in the suture to hold portions of the layer together. The suture and elastomeric adhesive may also mitigate shock waves that are imparted to the helmet.

In addition, the second portion of the shell may include multiple energy dissipaters, such as elastomeric tapered spirals. The energy dissipaters may be configured to dissipate energy imparted to the helmet. In particular, the energy dissipaters may dissipate energy through shear action in the energy dissipaters.

Thus, various embodiments of the helmets described herein may mitigate shock waves, trap momentum, and dissipate energy so that the risk of wears experiencing injuries, such as MTBI and CTE, are reduced. In the following discussion, a general description of the system and its components is provided, followed by a discussion of the operation of the same.

Figure 1:
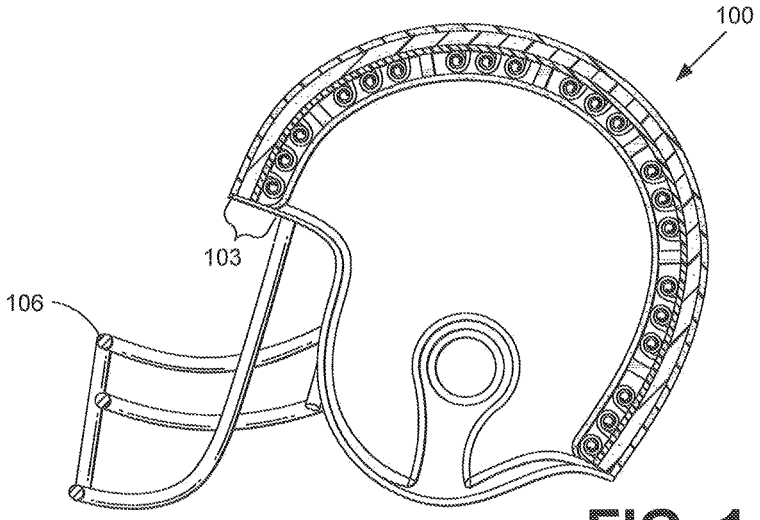
FIG. 1 is a drawing of an example of a helmet according to various embodiments of the present disclosure.

With reference to FIG. 1, shown is a cross-section of an example of a helmet 100 according to various embodiments. The helmet 100 shown in FIG. 1 is embodied in the form of a football helmet. However, in alternative embodiments, the helmet 100 may be embodied in the form of other types of athletic helmets, such as hockey helmets, lacrosse helmets, etc. Additionally, the helmet 100 in other examples may be embodied in the form of a racing helmet, such as an automotive racing helmet, a motorbike racing helmet, etc. In addition, the helmet 100 in alternative examples may be embodied in the form of a tactical helmet, which may be used, for example, by law enforcement or military personnel.

The helmet 100 may comprise a shell 103, a facemask 106, a liner (not shown), and/or other components. The shell 103 may be the outermost portion of the helmet 100 that surrounds at least a portion of the wear's head. Accordingly, the exterior surface of the shell 103 may contact objects, such as other helmets 100, when in use. The facemask 106 may protect the face of the wearer of the helmet 100.

Figure 2A:
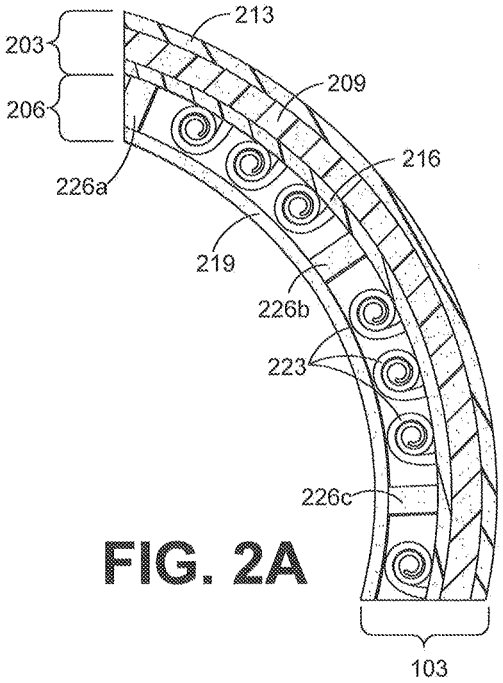
FIG. 2A is a drawing of a first example of a shell for the helmet of FIG. 1 according to various embodiments of the present disclosure.

With reference to FIG. 2A, shown is a cross-section of a portion of an example of the shell 103 according to various embodiments. The shell 103 illustrated in FIG. 2A is a multilayer shell 103 that comprises a first portion 203 and a second portion 206. For the embodiment shown in FIG. 2A, the first portion 203 of the shell 103 is on the exterior side of the shell 103, and the second portion 206 of the shell 103 is on the interior side of the shell 103. However, in alternative embodiments, the first portion 203 of the shell 103 may be on the interior side of the shell 103, and the second portion 206 of the shell 103 may be on the exterior side of the shell 103. Additionally, for the embodiment illustrated in FIG. 2A, the first portion 203 of the shell 103 is in direct contact with the second portion 206 of the shell 103. In alternative embodiments, the first portion 203 of the shell 103 may be separated from the second portion 206 of the shell 103.

Figure 2B:
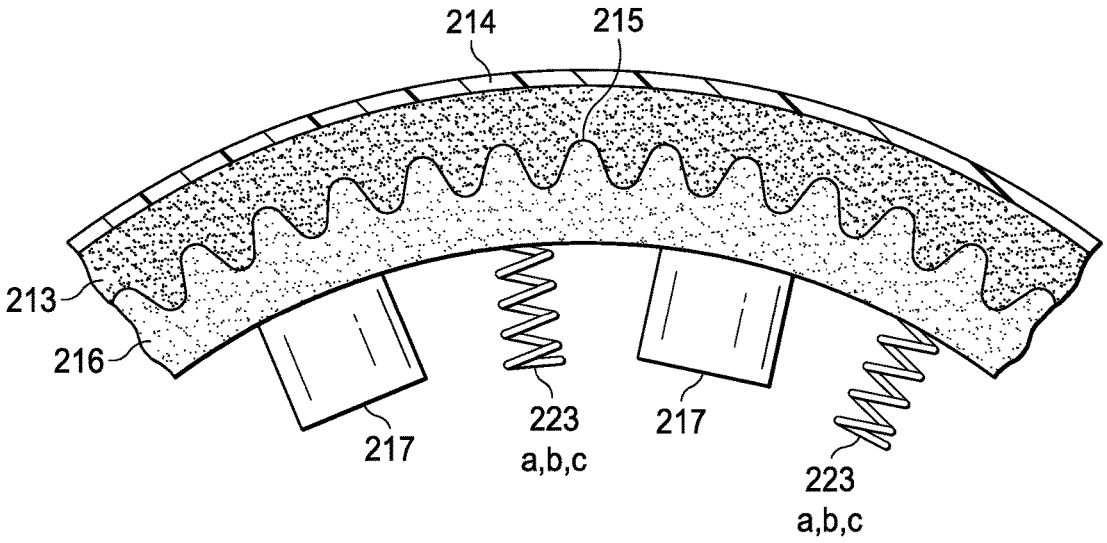
FIG. 2B is a drawing of a second example of a shell for the helmet of FIG. 1 according to various embodiments of the present disclosure.

FIGS. 2A and 2B show different configurations for the shell. The embodiment illustrated in FIG. 2A shows that the first portion 203 of the shell 103 may include a core layer 209 that is positioned between a first surrounding layer 213 and a second surrounding layer 216. The first surrounding layer 213 and the second surrounding layer 216 may comprise a para-aramid synthetic fiber, such as a KEVLAR, carbon, E-glass, or S-Glass fiber, that is fixed in a polymeric matrix. In FIG. 2B, a layer 214 is added that may be a very hard, slippery layer comprising a thermoset or thermoplastic on the outside of layer 213. Such a matrix for any configuration in FIGS. 2A-2B may comprise polypropylene, polyurethane, polycarbonate, and/or any other suitable material. The first surrounding layer 213 and the second surrounding layer 216 may be denser and less porous than the core layer 209. FIG. 2B also includes layer 215, which comprises a wavy suture material made of a nonlinear highly deforming elastic material, viscoelastic, and/or viscoplastic material. Layer 216 comprises a polymeric thermoplastic or thermoset that is highly ductile that can be, but is not limited to, a polycarbonate, sorbothane, etc.

For the configuration illustrated in FIG. 2A, the core layer 209 may comprise a foam. For example, the core layer 209 in one embodiment comprises a polymeric foam that can be, but is not limited to, a SUNMATE foam. The core layer 209 may be less dense and more porous than both the first surrounding layer 213 and the second surrounding layer 216. Accordingly, the first portion 203 of the shell 103 may be functionally graded. For the configuration illustrated in FIG. 2B, layer 217 can be a closed or open cell polymeric foam that can be used for energy absorption. This foam material can be, but is not limited to, a SUNMATE foam.

The second portion 206 of the shell 103 may include a side layer 219, a plurality of energy dissipaters 223, and a plurality of support columns 226*a*-226*c*. In some embodiments, the side layer 219 may comprise a para-aramid synthetic fiber, such as a KEVLAR, carbon, E-glass, or S-glass fiber, fixed in a matrix, such as a polypropylene, polyurethane, polycarbonate, and/or any other suitable matrix.

The support columns 226*a*-226*c* may attach the side layer 219 to the first portion 203 of the shell 103. For the embodiments illustrated in FIGS. 2A-2B, the support columns 226*a*-226*c* attach to both the side layer 219 and the second surrounding layer 216. In addition, the support columns 226*a*-226*c* may position the side layer 219 so that the side layer 219 does not contact the energy dissipaters 223. In some embodiments, the support columns 226*a*-226*c* comprise a polycarbonate.

The energy dissipaters 223 are configured to dissipate energy that is imparted to the helmet 100. In some embodiments, energy dissipaters 223 may dissipate energy by a shearing action in the energy dissipater 223. Examples of energy dissipaters 223 are described in further detail below. In some embodiments, the energy dissipaters 223 may be arranged in rows throughout at least a portion of the shell 103, as illustrated in FIGS. 2A-2B.

Figure 3:
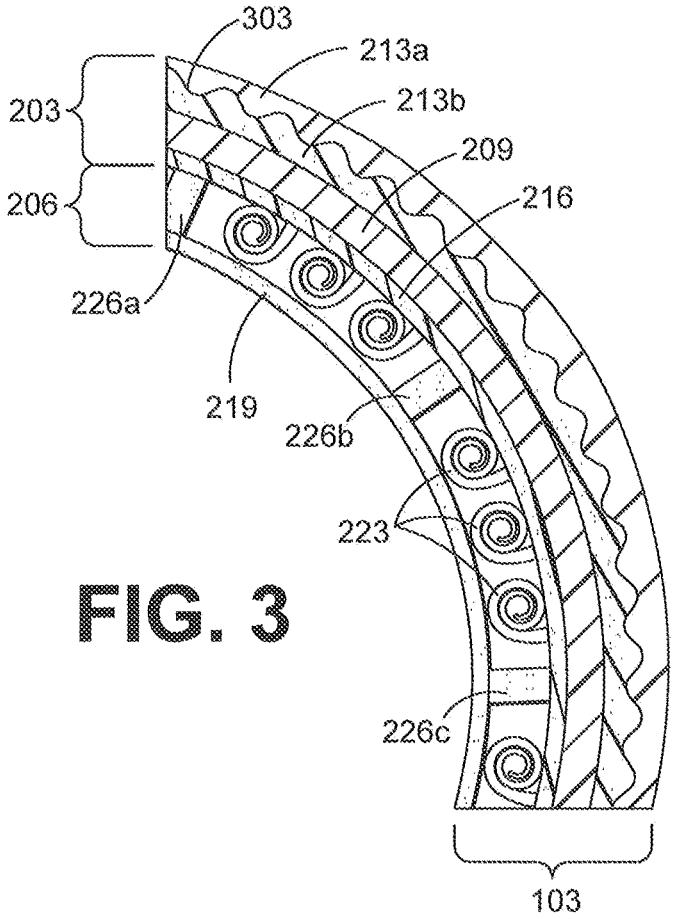
FIG. 3 is a drawing of a third example of a shell for the helmet of FIG. 1 according to various embodiments of the present disclosure.

With reference to FIG. 3, shown is a cross-section of a portion of another example of the shell 103, according to various embodiments. The shell 103 has some features that are similar to the shell 103 illustrated in FIG. 2. However, the first surrounding layer 213 of the first portion 203 of the shell 103 is segmented into a first surrounding layer portion 213*a* and a second surrounding layer portion 213*b*.

In particular, a suture 303 may exist between the first surrounding layer portion 213*a* and the second surrounding layer portion 213*b*. The suture 303 may be regarded as being a relatively rigid joint between the first surrounding layer portion 213*a* and the second surrounding layer portion 213*b*. In some embodiments, the suture 303 may extend around the entire shell 103. In other embodiments, the suture 303 may extend around only a portion of the shell 103. The suture 303 may comprise an elastomeric adhesive. In addition to attaching the first surrounding layer portion 213*a* to the second surrounding layer portion 213*b*, the elastomeric adhesive may facilitate shear deformation in the first surrounding layer 213 when the helmet 100 is subjected to an impact.

The suture 303 may have a sinusoidal shape that is curved to conform to the shape of the shell 103. In these embodiments, the ratio of the amplitude to the wavelength may be within the range from about 0.25 to about 2.0.

Figure 4:
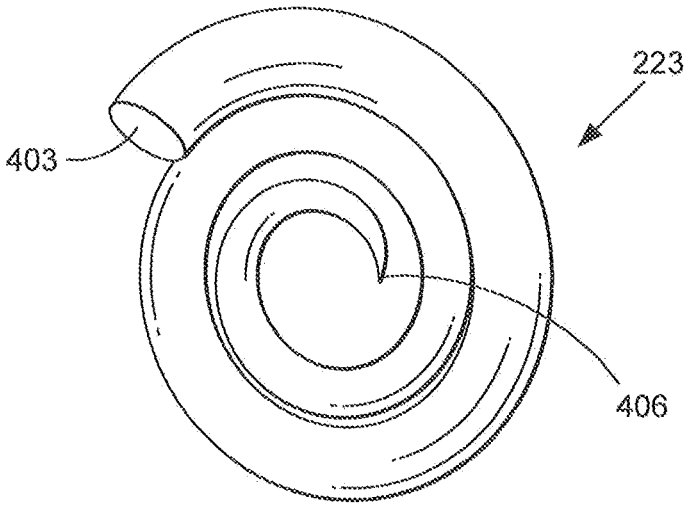
FIG. 4 is a drawing of a first example of an energy dissipater for the helmet of FIG. 1 according to various embodiments of the present disclosure.

With reference to FIG. 4, shown is an example of an energy dissipater 223 according to various embodiments. The energy dissipater 223 may comprise an elastomeric material, such as rubber. In some embodiments, the energy dissipater 223 may comprise a shock mitigating element, such as a tapered spiral shaped element described in U.S. patent application Ser. No. 13/469,172, filed on May 11, 2012, Publication No. US 2014/0026279, and titled "Shock Mitigating Materials and Methods Utilizing Spiral Shaped Elements," which is incorporated by reference herein in its entirety.

The energy dissipater 223 illustrated in FIG. 4 comprises a tapered spiral structure. In particular, the energy dissipater 223 shown comprises a base 403 and a tip 406 that has a diameter less than the diameter of the base 403. In some embodiments, the ratio of the diameter of the tip 406 to the diameter of the base 403 may be within the range from about 0.1 to about 0.9. Additionally, the ratio of the diameter of the base 403 to the spiral length may be from about 0.01 to about 1.0.

The base 403 of the energy dissipater 223 may be attached directly to the second surrounding layer 216 of the first portion 203 of the shell 103. When the helmet 100 is subjected to an impact, energy may be transferred to the energy dissipater 223 and dissipated through shear action in the energy dissipater 223.

Figure 5:
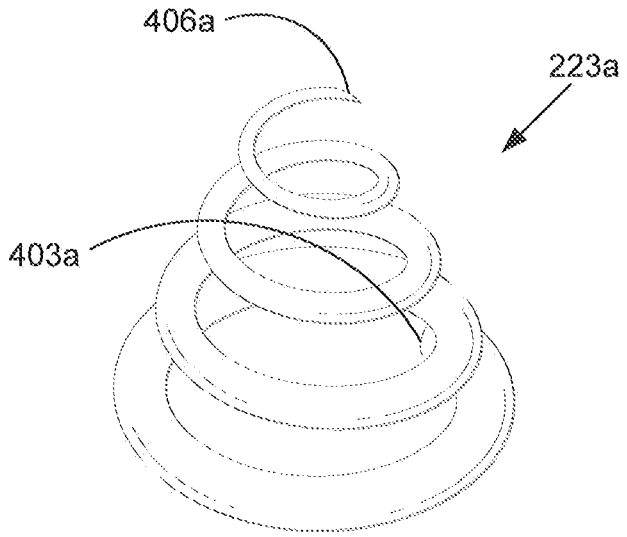
FIG. 5 is a drawing of a second example of an energy dissipater for the helmet of FIG. 1 according to various embodiments of the present disclosure.

With reference to FIG. 5, shown is another example of an energy dissipater 223, referred to herein as the energy dissipater 223*a*. The energy dissipater 223*a* is a tapered conic helix rod structure. In this regard, the energy dissipater 223*a* forms a conic helix, and the diameter of the energy dissipater 223*a* tapers as the length progresses from the base 403*a* (fixed end) to the tip 406*a* (free end). The rod tapers continuously along its length from the fixed end to the free end so that the fixed end exhibits a larger internal cross sectional area than the free end. The free end is capable of vibrating when the helmet 100 is impacted by an object in order to dissipate impact energy.

The base 403*b* of the energy dissipater 223*b* may be attached directly to the second surrounding layer 216 of the first portion 203 of the shell 103. When the helmet 100 is subjected to an impact, energy may be transferred to the energy dissipater 223*b* and dissipated through shear action in the energy dissipater 223*b*. In the various embodiments, the rod of the energy dissipaters extends from a fixed end to a free end and extends toward the user when the helmet is worn.

Figure 6:
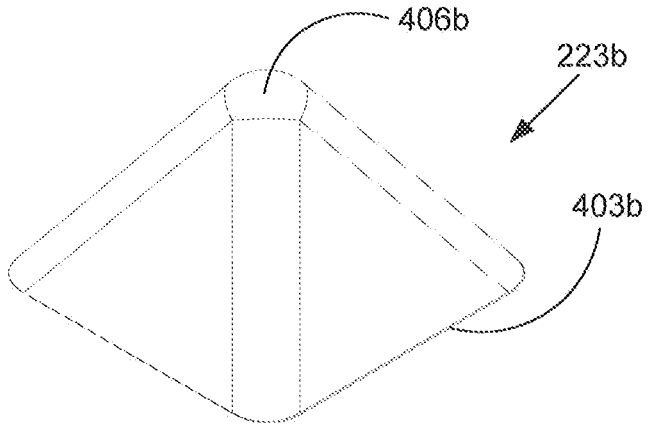
FIG. 6 is a drawing of a third example of an energy dissipater for the helmet of FIG. 1 according to various embodiments of the present disclosure.

With reference to FIG. 6, shown is another example of an energy dissipater 223, referred to herein as the energy dissipater 223*b*. The energy dissipater 223*b* is a tetrahedral structure. As such, the energy dissipater 223*b* tapers from the base 403*b* to the tip 406*b*.

The base 403*b* of the energy dissipater 223*b* may be attached directly to the second surrounding layer 216 of the first portion 203 of the shell 103. When the helmet 100 is subjected to an impact, energy may be transferred to the energy dissipater 223*b* and dissipated through shear action in the energy dissipater 223*b*.

Numerical values may be expressed herein in a range format. Such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also include individual concentrations (e.g., 1%, 2%, 3%, and 4%) and the sub-ranges (e.g., 0.5%, 1.1%, 2.2%, 3.3%, and 4.4%) within the indicated range. The term "about" may include traditional rounding according to significant figures of the numerical value.

The above-described embodiments of the present disclosure are merely examples of implementations to set forth for a clear understanding of the principles of the disclosure. Many variations and modifications may be made to the above-described embodiments without departing substantially from the spirit and principles of the disclosure. All such modifications and variations are intended to be included herein within the scope of this disclosure. Disjunctive language used herein, such as the phrase "at least one of X, Y, or Z," unless specifically stated otherwise, is used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

Therefore, the following is claimed:

1. A helmet, comprising:

a shell that comprises:

a first portion comprising a first layer, a second layer, and a third layer, wherein the second layer is positioned between the first layer and the third layer, wherein the second layer is less dense than the first layer and the third layer; and a second portion comprising a plurality of energy dissipaters mounted within the second portion of the shell, each of the plurality of energy dissipaters having a rod that extends in a spiraling manner from an end which is fixed to the first portion and extends away from the first portion to a free end and configured to extend toward a user when the helmet is worn, the rod tapering continuously along a length of the rod from the end which is fixed to the first portion to the free end so that the end which is fixed to the first portion exhibits a larger internal cross sectional area than the free end, the free end capable of vibrating when the helmet is impacted by an object in order to dissipate impact energy, wherein longitudinal mechanical shock wave energy from such impact is transformed into shear wave energy.

2. The helmet of claim 1, wherein the plurality of energy dissipaters are mounted directly to the first portion of the shell.

3. The helmet of claim 1, wherein at least one of the plurality of energy dissipaters comprises a tapered conic helix structure.

4. The helmet of claim 1, wherein the first layer of the first portion of the shell comprises a para-aramid synthetic fiber in a matrix.

5. The helmet of claim 1, wherein the second layer of the first portion of the shell comprises a foam.

6. The helmet of claim 1, wherein the third layer of the first portion of the shell comprises a para-aramid synthetic fiber in a matrix.

7. The helmet of claim 1, wherein at least one of the plurality of energy dissipaters comprises a tapered spiral structure.

8. The helmet of claim 1, wherein at least one of the plurality of energy dissipaters comprises a tetrahedral structure.

9. A helmet, comprising:

a shell that comprises a first layer and a second layer; and a plurality of energy dissipaters positioned between the first layer and the second layer, each of the plurality of energy dissipaters having a rod that extends in a spiraling manner from an end which is fixed to the first layer and extends away from the first layer to a free end and configured to extend toward a user when the helmet is worn, the rod tapering continuously along a length of the rod from the end which is fixed to the first layer to the free end so that the end which is fixed to the first layer exhibits a larger internal cross sectional area than the free end, the free end capable of vibrating when the helmet is impacted by an object in order to dissipate impact energy, wherein longitudinal mechanical shock wave energy from such impact is transformed into shear wave energy.

10. The helmet of claim 9, wherein at least one of the plurality of energy dissipaters is mounted to the first layer and is not in contact with the second layer.

11. The helmet of claim 9, wherein at least one of the plurality of energy dissipaters comprises a helical tapered spiral structure.

12. The helmet of claim 9, wherein at least a subset of the plurality of energy dissipaters are arranged in at least one row.

13. The helmet of claim 9, wherein at least one of the plurality of energy dissipaters comprises a tapered spiral structure.

14. The helmet of claim 9, wherein at least one of the plurality of energy dissipaters comprises a tetrahedral structure.

15. A helmet, comprising:

a shell that comprises:

a first layer having a first density;

a second layer having a second density; and a third layer having a third density, wherein the second layer is positioned between the first layer and the third layer, and wherein the second density of the second layer is less than both the first density of the first layer and the third density of the third layer;

a plurality of energy dissipaters mounted within the shell, each of the plurality of energy dissipaters having a rod that extends in a spiraling manner from an end which is fixed to the third layer and extends away from the third layer to a free end and configured to extend toward a user when the helmet is worn, the rod tapering continuously along a length of the rod from the end which is fixed to the third layer to the free end so that the end which is fixed to the third layer exhibits a larger internal cross sectional area than the free end, the free end capable of vibrating when the helmet is impacted by an object in order to dissipate impact energy, wherein longitudinal mechanical shock wave energy from such impact is transformed into shear wave energy.

16. The helmet of claim 15, wherein the shell further comprises a fourth layer and the plurality of energy dissipaters are mounted between the third layer and the fourth layer.

17. The helmet of claim 16, wherein the fourth layer comprises a para-aramid synthetic fiber.

18. The helmet of claim 15, wherein:

the first layer comprises a first para-aramid synthetic fiber;

the second layer comprises a foam; and the third layer comprises a second para-aramid synthetic fiber.

19. The helmet of claim 15, wherein an elastomeric suture exists between a first portion and a second portion of the first layer of the shell.

* * * * *